US006637327B2

(12) United States Patent
Endo et al.

(10) Patent No.: US 6,637,327 B2
(45) Date of Patent: Oct. 28, 2003

(54) IMAGE EXPOSURE CONTROL APPARATUS IN MULTICOLOR PRINTING PRESS

(75) Inventors: Yasuji Endo, Ibaraki (JP); Takashi Fuseki, Ibaraki (JP)

(73) Assignee: Komori Corporation, Tokyo (JP)

( * ) Notice: Subject to any disclaimer, the term of this patent is extended or adjusted under 35 U.S.C. 154(b) by 24 days.

(21) Appl. No.: 10/108,030

(22) Filed: Mar. 26, 2002

(65) Prior Publication Data

US 2002/0139259 A1 Oct. 3, 2002

(30) Foreign Application Priority Data

Mar. 27, 2001 (JP) ..... 2001-090312

(51) Int. Cl.[7] ..... B41F 5/16

(52) U.S. Cl. ..... 101/181; 101/211; 101/248; 101/485; 101/486

(58) Field of Search ..... 101/181, 211, 101/248, 484, 483, 486; 358/1.5, 1.9

(56) References Cited

U.S. PATENT DOCUMENTS 5,136,316 A * 8/1992 Punater et al. ..... 347/154
5,138,667 A * 8/1992 Roch et al. ..... 101/181
5,379,698 A 1/1995 Nowak et al. ..... 101/454
5,806,430 A * 9/1998 Rodi ..... 101/211
5,857,784 A * 1/1999 Allen ..... 101/248
6,026,172 A * 2/2000 Lewis, Jr. et al. ..... 382/106
6,164,847 A * 12/2000 Allen ..... 400/74
6,283,467 B1 9/2001 Iida ..... 101/409
6,331,901 B1 * 12/2001 Fukuda et al. ..... 358/1.9

FOREIGN PATENT DOCUMENTS

JP 2000-309084 11/2000

* cited by examiner

*Primary Examiner*—Eugene H. Eickholt
(74) *Attorney, Agent, or Firm*—Blakely, Sokoloff, Taylor & Zafman

(57) ABSTRACT

An image exposure control apparatus includes a memory and an adjustment section. The memory stores a correction amount for each color in accordance with a stretch amount of a printing paper sheet in multicolor printing operation. The adjustment section adjusts an exposure position of a pixel of an image to be exposed for each color, on the basis of the correction amount read out from said memory means, in exposing the image on a printing plate.

9 Claims, 8 Drawing Sheets

IMAGE EXPOSURE CONTROL APPARATUS IN MULTICOLOR PRINTING PRESS

BACKGROUND OF THE INVENTION

The present invention relates to a control apparatus for an image exposure apparatus which exposes an image on a printing plate, an image exposure apparatus, and a control apparatus which controls a multicolor printing press.

[Plate Making on Press]

In recent years, in order to improve the efficiency of plate making operation or to improve the registration accuracy, a plate making apparatus is attached to a printing press itself whereby plate making operation is directly performed on the printing press by the plate making apparatus. That is, instead of using a plate making apparatus separated from a printing press, a printing plate (raw plate) mounted on a plate cylinder is irradiated with a laser beam from the head of a plate making apparatus attached to a printing unit, thereby exposing an image. This operation is called plate making on press.

More specifically, the rotational speed of the printing press is increased to a designated value. When the rotational speed has stabilized, laser irradiation (exposure) from the head to the printing plate is started. After that, the head is moved in the axial direction of the plate cylinder while continuing exposure, thereby exposing an image on the entire plate mounted on the plate cylinder. The exposure time is determined by the plate size and the designated rotational speed at the time of exposure. Techniques for exposing an image on a printing plate by laser irradiation are disclosed in U.S. Pat. No. 5,379,698 (reference 1) and the like, and a detailed description thereof will be omitted.

FIG. 4 shows the attached state of plate making apparatuses to a four-color rotary printing press. Referring to FIG. 4, plate making apparatuses 102-1 to 102-4 are attached to printing units 101-1 to 101-4 of the respective colors. The plate making apparatuses 102-1 to 102-4 are normally at positions indicated by the alternate long and two dashed lines in FIG. 4. When exposure operation is to be performed, they are moved close to plate cylinders 103-1 to 103-4 in the printing units 101-1 to 101-4. Reference numerals 104-1 to 104-4 denote blanket cylinders on which blankets are mounted. Impression cylinders (not shown) are arranged under the blanket cylinders 104-1 to 104-4.

FIG. 5 shows main part of a plate making apparatus 102. The plate making apparatus 102 has an exposure unit 102*b* having a head 102*a*. The exposure unit 102*b* is fixed on a table 102*c*. The table 102*c* moves in the axial direction (indicated by a double-headed arrow A–B) of a plate cylinder 103 while being guided along rails 102*f*1 and 102*f*2 on a base 102*f* by a ball screw 102*e* rotated by a motor 102*d*. A printing plate (raw plate) 105 is mounted on the surface of the plate cylinder 103.

In plate making on press, the exposure range of an image onto the printing plate 105 is set before the start of actual image exposure by causing an operator to input the X-coordinate distance (X1,0) from the origin (0,0) at the left edge on the leading edge side of the printing plate 105 to the left edge of the image range and the Y-coordinate distance (0,Y1) to the leading edge of the image range, as shown in FIG. 6. That is, let W be the image size in the X-axis direction, and H be the image size in the Y-axis direction. The origin (0,0) is defined at the left edge on the leading edge side of the printing plate 105. The image range is defined by X-coordinates "X1" and "X1+W" and Y-coordinates "Y1" and "Y1+H".

Assume that the number of pixels of the image is n in the X-axis direction and m in the Y-axis direction, as shown in FIG. 7. A distance ΔX between the pixels in the X-axis direction is given by ΔX=W/n, and a distance ΔY between the pixels in the Y-axis direction is given by ΔY=H/m. The plate making apparatus 102 defines ΔX and ΔY as the exposure intervals in the X- and Y-axis directions and exposes image data that is input in advance within that image range.

More specifically, the head 102*a* of the plate making apparatus 102 is moved from the left to the right while rotating the plate cylinder 103 at a predetermined rotational speed. The head 102*a* is stopped at the position X1, and the pixels of one line in the Y direction are exposed at the interval ΔY. That is, pixels within the range from (X1,Y1) to (X1,Y1+H) are exposed. Next, the head 102*a* is moved to the right by ΔX. At the next position, the pixels of the next line in the Y direction are exposed at the interval ΔY. This operation is repeated until the X-coordinate "X1+W".

The image data (image "1"/non-image "0") of each pixel is not stored in correspondence with the data of its exposure position. Only data of image "1"/non-image "0" are sequentially stored. In actual exposure, the image data are sequentially read out, and the pixels are sequentially exposed from the position (X1,Y1) at the interval ΔY in the Y direction and at the interval ΔX in the X direction. This is because the number of image data to be processed is enormous. If the image data are collated with position data and exposed one by one, a very long time and large storage capacity are impractically required.

In printing by a rotary printing press, a high pressure must be applied to printing paper between the blanket cylinder and the impression cylinder. For this reason, the printing paper stretches toward the trailing edge side. Hence, the image printed by the preceding printing unit expands into a wide trapezoidal shape toward the trailing edge side, resulting in misregistration between colors. This tendency is especially conspicuous in offset printing because printing is executed with water supplied.

FIG. 8 shows an image state on printing paper after printing of the second color. A printing paper sheet 106 stretches due to printing by the second-color printing unit, and a first-color image 107 expands into a trapezoidal shape. For this reason, shifts are generated between the first-color image 107 and a second-color image 108. That is, shifts w1 and w2 in the horizontal direction (a direction perpendicular to the sheet convey direction) of the printing paper sheet 106, a shift h in the vertical direction (sheet convey direction), and shifts (distortion amounts) s1 and s2 due to distortions are generated. Similarly, the first- and second-color images further expand into trapezoidal shapes due to printing by the third-color printing unit. The first-, second-, and third-color images further expand into trapezoidal shapes due to printing by the fourth-color printing unit. In this way, shifts are generated between the color images, resulting in a defective printing product.

To solve this problem, the present applicant proposed in Japanese Patent Laid-Open No. 2000-309084 (U.S. Pat. No. 6,283,467; reference 2) a sheet-like object convey apparatus which stretches the trailing edge side of a printing paper sheet in the horizontal direction (right-to-left direction) upon transferring the printing paper sheet to a printing section whereby the shape of the printing paper sheet is deformed in advance into a trapezoidal shape whose width increases toward the trailing edge side to eliminate or reduce the stretch of the printing paper sheet during printing, thereby eliminating or reducing the shift of the image due to distortion by the stretch of the printing paper sheet during printing. The correction operation of the sheet-like object convey apparatus disclosed in reference 2 will be described with reference to FIGS. 10 and 11.

Referring to FIG. 10, when a swing 1 pivots from a point b to a point a, i.e., the gripping position of a feeding cylinder 4 along with rotation of a feeding cylinder shaft 4*a,* the edge portion of a paper sheet 6 is gripped by a plurality of gripper units (not shown) each formed from a gripper and gripper pad. Simultaneously, the central portion of a support shaft (not shown) that supports the gripper units is pressed and deflected by α, as indicated by the alternate long and two dashed line in FIG. 11. When the support shaft deflects, the gripper units at the central portion retreat from those on both sides by α. In this state, when the feeding cylinder shaft 4*a* rotates to move the swing 1 from the point a to the point b, press against the support shaft is canceled. All the gripper units are aligned on one line, as indicated by the solid line in FIG. 11.

When the gripper units at the central portion move, the directions of gripper units are changed toward the left and right end sides of the paper sheet 6 from the central portion relatively to those in gripping the paper sheet. The paper sheet 6 is stretched to become wide toward the trailing edge side. With this operation, the paper sheet 6 is deformed in advance into a trapezoidal shape whose width increases toward the trailing edge side before printing. Since the stretch of the printing paper sheet during printing is eliminated or reduced, the shift of the image due to distortion by the stretch of the printing paper sheet during printing is eliminated or reduced. Hence, fan-out registration is corrected. Reference numeral 5 denotes a lower swing; 6*a,* a feedboard; and 7, an impression cylinder.

According to the sheet-like object convey apparatus described in reference 2, of the shifts of the image, the shifts s1 and s2 due to distortions are corrected, as shown in FIG. 9. However, since the shifts w1 and w2 in the horizontal direction and the shift h in the vertical direction cannot be corrected, defective printing products cannot be completely avoided.

SUMMARY OF THE INVENTION

It is an object of the present invention to provide a control apparatus for an image exposure apparatus, which eliminates misregistration between colors due to stretch of a printing paper sheet and prevents any defective printing product.

In order to achieve the above object, according to the present invention, there is provided an image exposure control apparatus comprising memory means for storing a correction amount for each color in accordance with a stretch amount of a printing paper sheet in multicolor printing operation, and adjustment means for adjusting an exposure position of a pixel of an image to be exposed for each color, on the basis of the correction amount read out from the memory means, in exposing the image on a printing plate.

DESCRIPTION OF THE PREFERRED EMBODIMENT

The present invention will be described below in detail with reference to the accompanying drawings.

Figure 9:
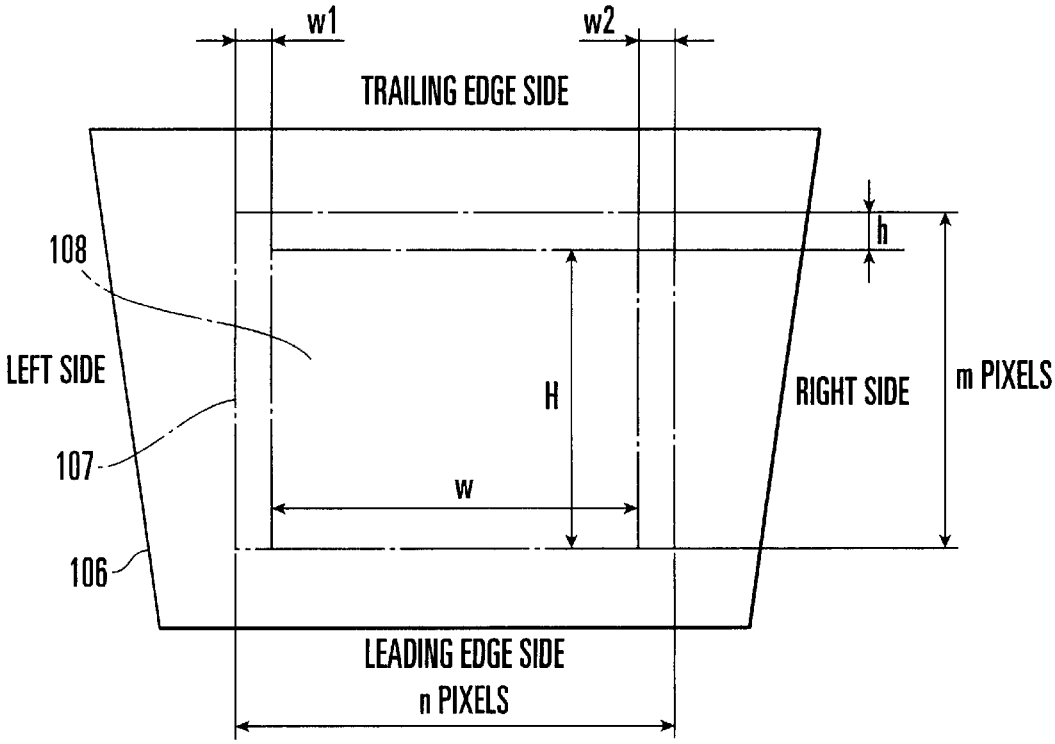
FIG. 9 is a view for explaining image shift correction in a conventional correction apparatus.
Figure 10:
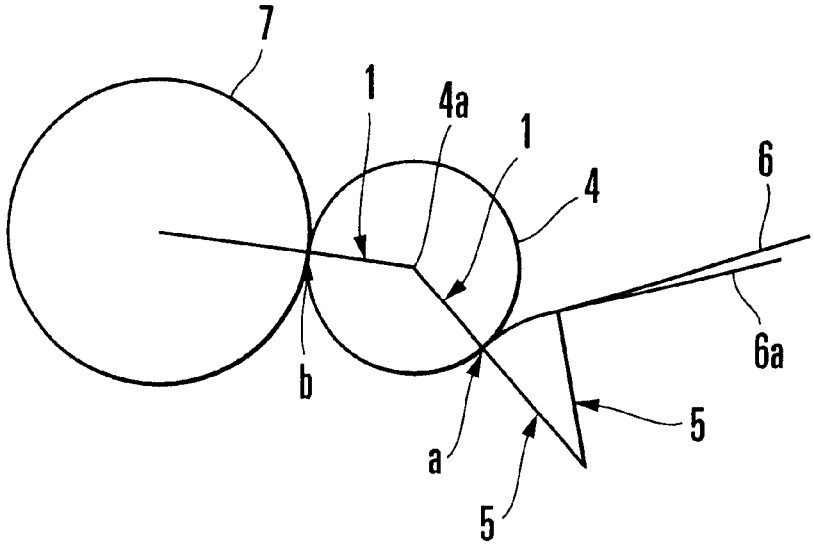
FIG. 10 is a side view showing the schematic arrangement of a conventional sheet-like object convey apparatus having a conventional correction function.
Figure 11:
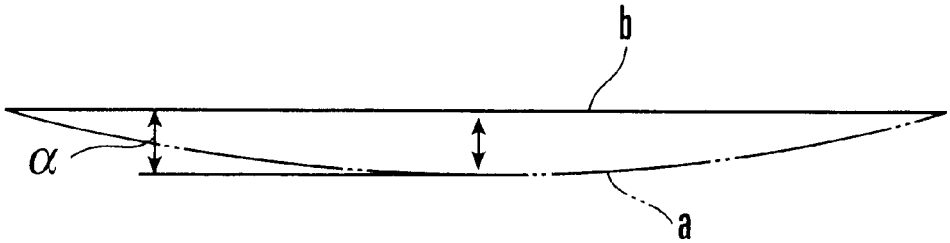
FIG. 11 is a view showing the positions of gripper units at the times of paper gripping and gripping change.

First, the principle of the present invention will be described. Referring to FIG. 9, to align a second-color image 108 with a first-color image 107, the X-coordinate at which image exposure to the second-color printing plate starts is moved by −w1 to set an X-axis direction pixel interval ΔX given by $$\Delta X=(W+w1+w2)/n$$

In addition, a Y-axis direction pixel interval ΔY is set to $$\Delta Y=(H+h)/m$$

That is, w1, w2, and h are measured in advance. The start position of image exposure to the second-color printing plate is adjusted from (X1,Y1) to (X1−w1,Y1). The pixel interval ΔX in the X-axis direction is adjusted from W/n to (W+w1+w2)/n. The pixel interval ΔY in the Y-axis direction is adjusted from H/m to (H+h)/m. Then, the second-color image 108 matches the first-color image 107.

In the present invention, for example, to expose an image to the second-color printing plate, w1, w2, and h are read out as correction amounts set in accordance with the stretch amount of the printing paper sheet. Next, on the basis of the readout correction amounts, the image exposure start position is adjusted from (X1,Y1) to (X1−w1,Y1). In addition, the pixel interval ΔX in the X-axis direction is adjusted from W/n to (W+w1+w2)/n. The pixel interval ΔY in the Y-axis direction is adjusted from H/m to (H+h)/m.

Figure 1:
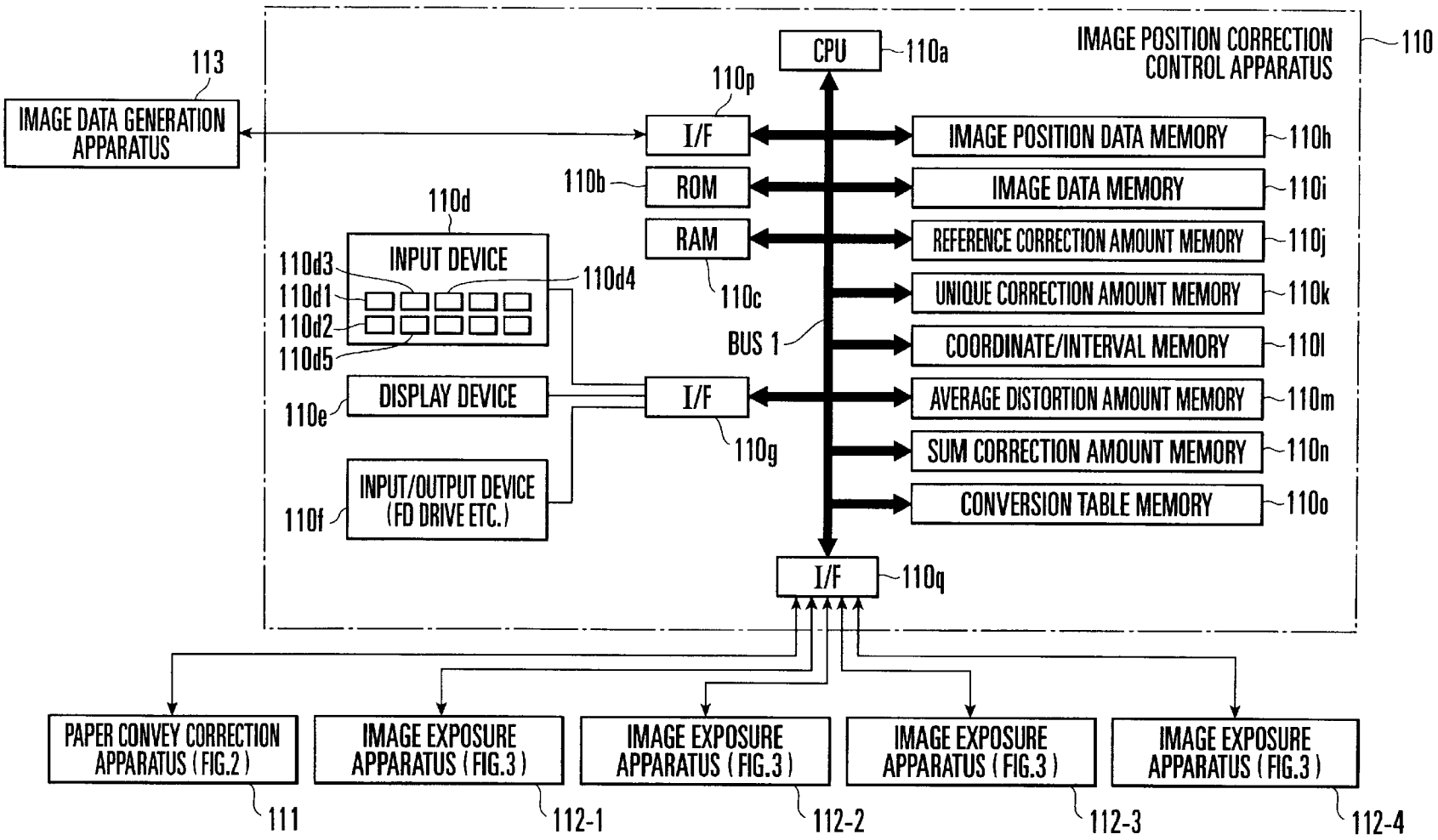
FIG. 1 is a block diagram of a control apparatus for an image exposure apparatus according to an embodiment of the present invention.

FIG. 1 shows a control apparatus for an image exposure apparatus according to an embodiment of the present invention. Referring to FIG. 1, reference numeral 110 denotes an image position correction control apparatus; 111, a paper convey apparatus; 112-1, an image exposure apparatus for the first-color printing plate; 112-2, an image exposure apparatus for the second-color printing plate; 112-3, an image exposure apparatus for the third-color printing plate; 112-4, an image exposure apparatus for the fourth-color printing plate; and 113, an image data generation apparatus. The paper convey apparatus 111, image exposure apparatuses 112-1 to 112-4, and image data generation apparatus 113 are connected to the image position correction control apparatus 110.

The image position correction control apparatus 110 comprises a CPU (Central Processing Unit) 110*a,* a ROM (Read Only Memory) 110*b,* a RAM (Random Access Memory) 110*c,* an input device 110*d* constructed by switches and operation keys, a display device 110*e,* and an input/output device 110*f* formed from a flexible disk drive and the like. The CPU 110*a* operates in accordance with a program stored in the ROM 110*b* in advance. The input device 110*d* comprises a reference correction amount storage mode switch 110*d*1, exposure start switch 110*d*2, correction reference amount storage switch 110*d*3, unique correction amount storage mode switch 110*d*4, and fan-out registration correction switch 110*d*5. The input device 110*d,* display device 110*e,* and input/output device 110*f* are connected to a bus BUS1 through an I/O interface (I/F) 110*g*.

An image position data memory 110*h* for storing image position data, an image data memory 110*i* for storing image data, a reference correction amount memory 110*j* for storing reference correction amounts, a unique correction amount memory 110*k* for storing unique correction amounts in correspondence with each type of printing paper sheet, a coordinate/interval memory 110*l* for storing X-axis direction pixel interval and Y-axis direction pixel interval of images of the respective colors, an average distortion amount memory 110*m* for storing an average distortion amount, a sum correction amount memory 110*n* for storing correction amounts to be output to the paper convey apparatus, and a conversion table memory 110*o* for storing a conversion table which converts a distortion amount into a correction amount of the paper convey apparatus are connected to the bus BUS1.

The image data generation apparatus 113 is connected to the bus BUS1 through an I/O interface (I/F) 110*p*. The paper convey apparatus 111 and image exposure apparatuses 112-1 to 112-4 are connected to the bus BUS1 through an I/O interface (I/F) 110*q*. The image data generation apparatus 113 supplies to the image position correction control apparatus 110 the image data of an image to be exposed to the printing plate of each color. The image data supplied to the image position correction control apparatus 110 is stored in the memory 110*i*.

The paper convey apparatus 111 has a paper convey mechanism 111*p* having the same structure as that of the sheet-like object convey apparatus disclosed in reference 2. The paper convey apparatus 111 deflects the gripper shaft in the paper convey direction in gripping, with swing grippers, the end portion of a sheet-like object that is supplied from the convey direction at the time of conveying a paper sheet in accordance with rotation of a motor (to be described later), thereby correcting the shape of the sheet-like object. When a printing paper sheet is transferred to a first-color printing unit 101-1 (FIG. 4) of the printing section, the paper convey mechanism 111*p* stretches the rear end portion of the printing paper sheet in the horizontal direction (a direction perpendicular to the paper convey direction) to deform in advance the paper into a trapezoidal shape whose width increases toward the leading edge side. As a result, the image after printing has an almost rectangular shape. For the arrangement of the paper convey mechanism 111*p,* the arrangement of the sheet-like object convey apparatus described in reference 2 is incorporated in this specification.

Figure 2:
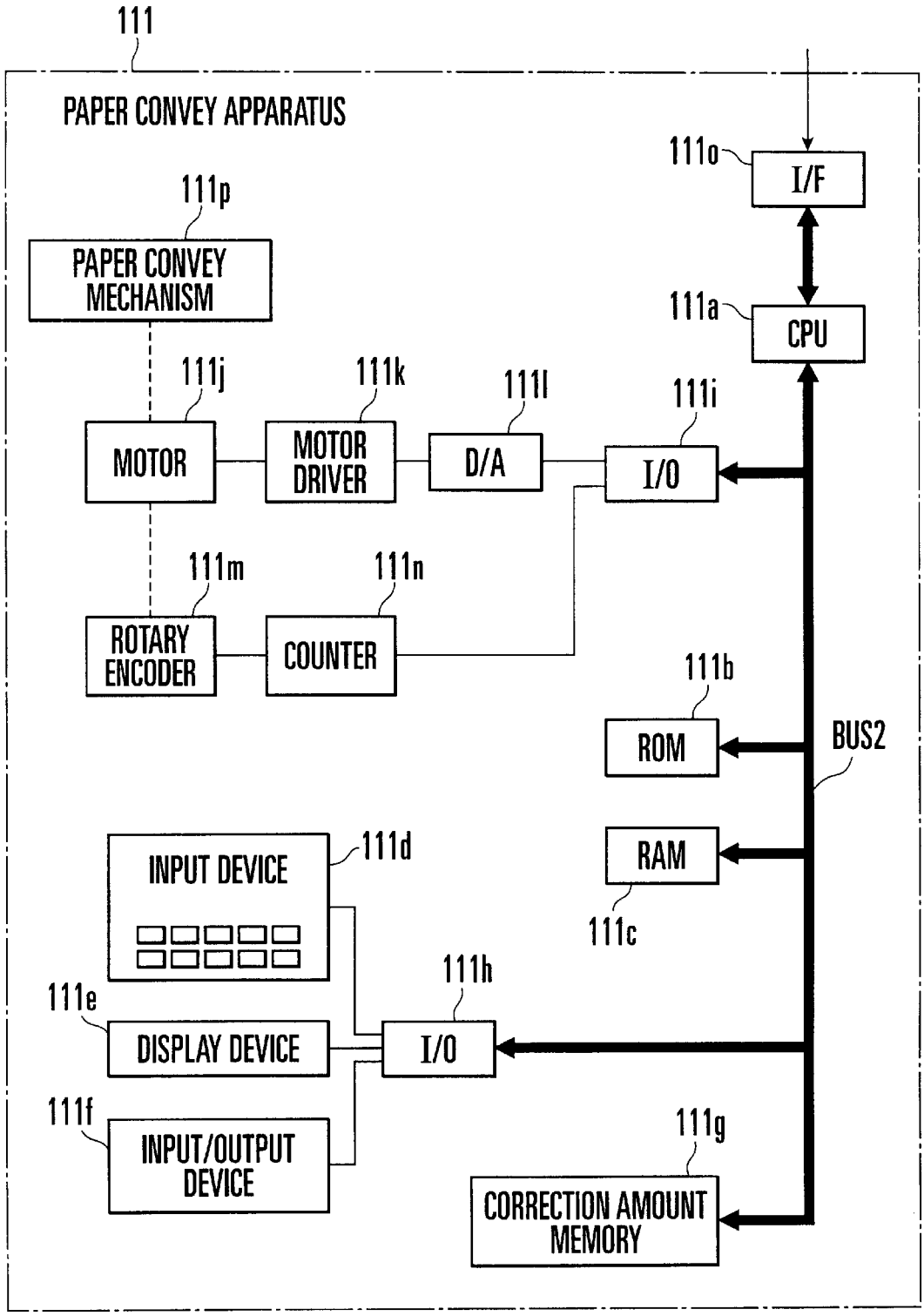
FIG. 2 is a block diagram of a paper convey apparatus shown in FIG. 1.

As shown in FIG. 2, the paper convey apparatus 111 comprises, in addition to the paper convey mechanism 111*p,* a CPU 111*a,* ROM 111*b,* RAM 111*c,* input device 111*d,* display device 111*e,* and input/output device 111*f*. The CPU 111*a* operates in accordance with a program stored in the ROM 111*b*. The input device 111*d,* display device 111*e,* and input/output device 111*f* are connected to a bus BUS2 through an I/O interface (I/F) 111*h*.

A correction motor 111*j* for the paper convey mechanism 111*p,* a motor driver 111*k,* a D/A converter 111*l,* a rotary encoder 111*m,* and a counter 111*n* are connected to the bus BUS2 through an I/O interface (I/F) 111*i*. A correction amount memory 111*g* for storing correction amounts is connected to the bus BUS2. As the motor 111*j* rotates, the press member (not shown) of the paper convey mechanism 111*p* displaces and deflects the gripper shaft (not shown).

Figure 4:
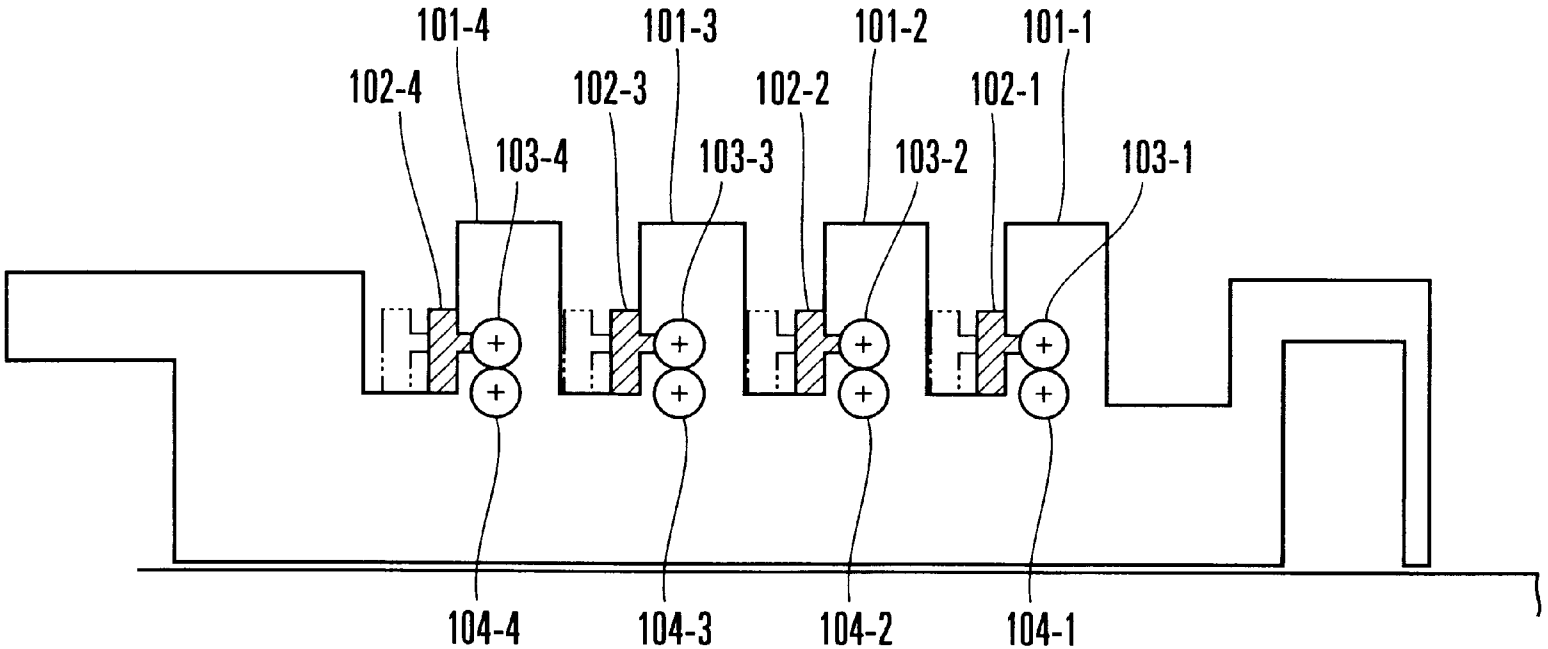
FIG. 4 is a side view showing the schematic arrangement of a four-color rotary printing press to which plate making apparatuses are attached.
Figure 5:
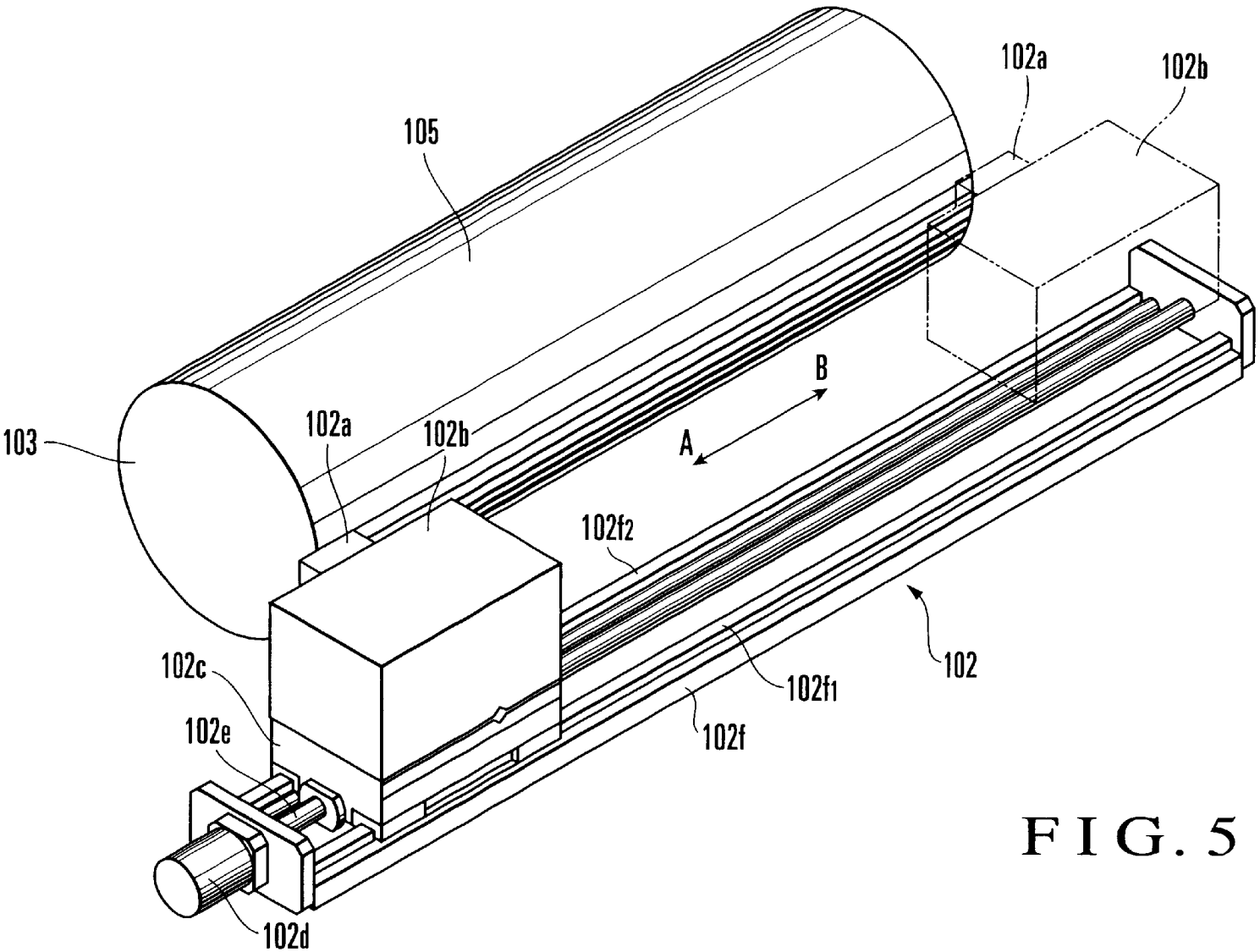
FIG. 5 is a perspective view showing main part of the plate making apparatus shown in FIG. 4.
Figure 6:
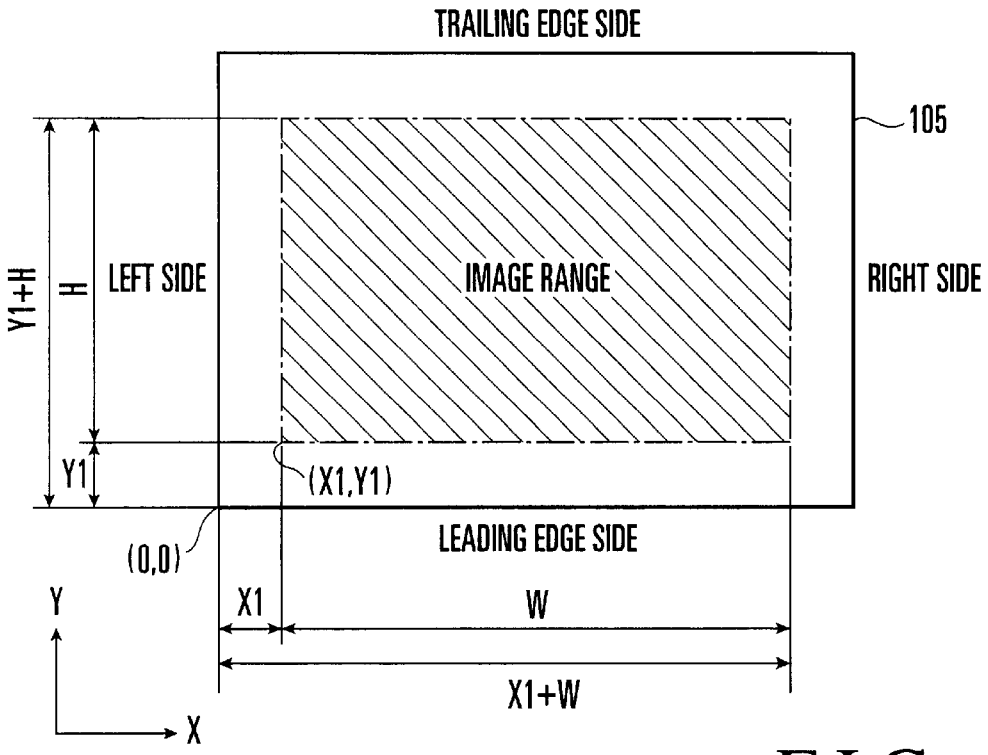
FIG. 6 is a view showing the image exposure range on a printing plate.
Figure 7:
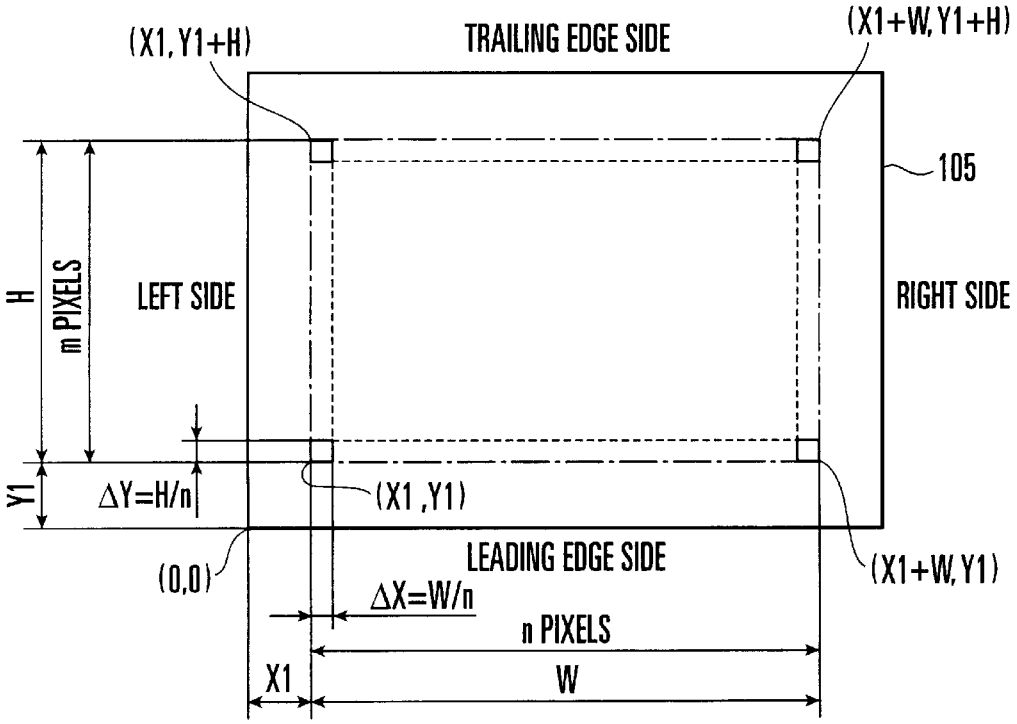
FIG. 7 is a view for explaining a pixel interval ΔX in the X-axis direction and a pixel interval ΔY in the Y-axis direction of an image to be exposed onto the printing plate.

The image exposure apparatuses 112-1 to 112-4 construct plate making apparatuses 102-1 to 102-4 shown in FIG. 4. The image exposure apparatuses expose images by irradiating printing plates (raw plates) mounted on the surfaces of plate cylinders 103-1 to 103-4 in printing units 101-1 to 101-4 with laser beams.

Figure 3:
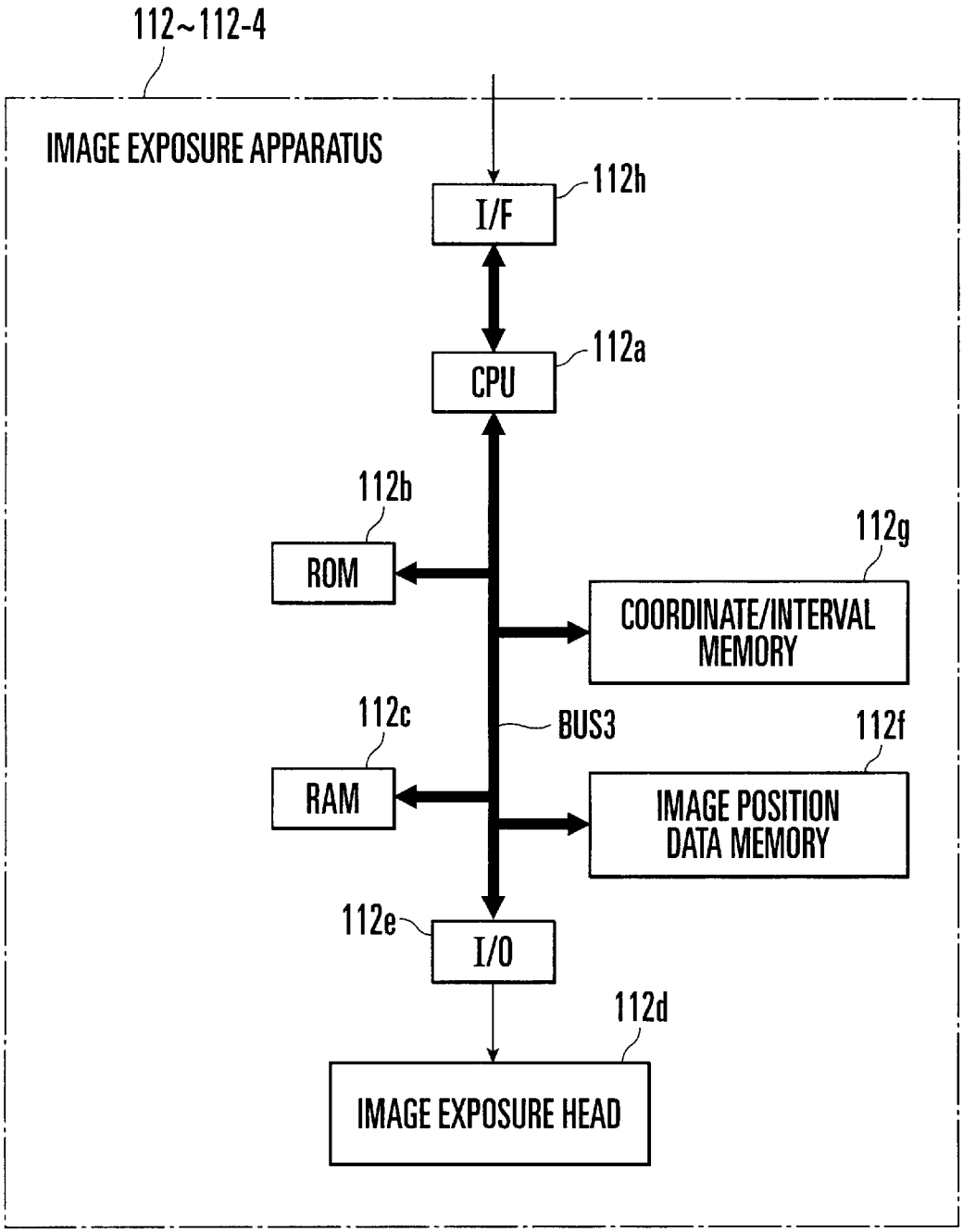
FIG. 3 is a block diagram of the image exposure apparatus shown in FIG. 1.

As shown in FIG. 3, each of the image exposure apparatuses 112-1 to 112-4 comprises a CPU 112*a,* ROM 112*b,* RAM 112*c,* and image exposure head 112*d* for exposing an image on a printing plate. The CPU 112*a* operates in accordance with a program stored in the ROM 112*b* in advance. The image exposure head 112*d* is connected to a bus BUS3 through an I/O interface (I/F) 112*e*. An image position memory 112*f* for storing image position data, and a coordinate/interval memory 112*g* for storing the X-coordinate of the left edge of an image to be exposed to the printing plate of each color and the X-axis direction pixel interval and Y-axis direction pixel interval of a color image are connected to the bus BUS3.

[Generation of Database]

At the beginning of operation, a database for various kinds of correction amounts (reference correction amounts and unique correction amounts for each type of printing paper sheet) is generated. This database is generated in the following way.

[Generation of Reference Correction Amounts]

The operator turns on the reference correction amount storage mode switch 110*d*1 of the input device 110*d* at the start of database generation. When the reference correction amount storage mode switch 110*d*1 is turned on, the CPU 110*a* sets all data in the memory 110*j* to 0. The memory 110*j* stores reference correction amounts w1Fi, w2Fi, and hFi (i=1 to 4) of the exposure positions of images of the respective colors and a reference correction amount s1F of the paper convey apparatus, as will be described later. All the reference correction amounts are reset to 0.

Next, the CPU 110*a* reads out image sizes "W" and "H" which are stored in the memory 110*i* together with image data. The CPU 110*a* calculates data (X1,Y1) of the accurate image position (exposure start position) and sets them in the memory 110*h* such that the W×H image matches the X-direction central position of the printing plate and the printing start position on the leading edge side.

The operator turns on the exposure start switch 110*d*2 of the input device 110*d*. When the exposure start switch 110*d*2 is turned on, the CPU 110*a* reads out, from the memory 110*j,* the reference correction amounts w1Fi, w2Fi, and hFi of the exposure position of images of the respective colors and the reference correction amount s1F of the paper convey apparatus. In this case, all the reference correction amounts w1Fi, w2Fi, hFi, and s1F of each color are 0.

The CPU 110*a* obtains the X-coordinate (X1−w1Fi) of the left edge of the image to be exposed to the printing plate of each color on the basis of the readout reference correction amounts w1Fi, w2Fi, and hFi. The CPU 110*a* also obtains the pixel interval ΔX in the X-axis direction of the image of each color as ΔX=(W+w1Fi+w2Fi)/n and the pixel interval ΔY in the Y-axis direction as ΔY=(H+hFi)/m. In this case, since the reference correction amounts w1Fi, w2Fi, and hFi of each color are 0, the X-coordinate of the left edge of the image to be exposed to the printing plate of each color is X1. The pixel interval ΔX in the X-axis direction of the image of each color is obtained as ΔX=W/n. The pixel interval ΔY in the Y-axis direction is obtained as ΔY=H/m.

The CPU 110*a* stores, in the memory 110*l*, the obtained values, i.e., the X-coordinate X1 of the left edge of the image to be exposed to the printing plate of each plate, the pixel interval ΔX=W/n in the X-axis direction of the image of each color, and the pixel interval ΔY=H/m in the Y-axis direction of the image of each color. The CPU 110*a* also sets identical data in the memory 112*g* of the image exposure apparatus 112 of each color. Next, the CPU 110*a* sets the data (X1,Y1) of the image position, which is stored in the memory 110*h*, in the memory 112*f* of the image exposure apparatus 112 of each color. The CPU 110*a* also sets the reference correction amount s1F (in this case, s1F=0) read out from the memory 110*j* in the memory 111*g* of the paper convey apparatus 111.

In the image exposure apparatus 112 of each color, the CPU 112*a* reads out the image position data (X1,Y1) set in the memory 112*f*, and the X-coordinate X1 of the left edge of the image to be exposed to the printing plate of a corresponding color, the pixel interval ΔX=W/n in the X-axis direction of the image of a corresponding color, and the pixel interval ΔY=H/m in the Y-axis direction of the image of a corresponding color, which are set in the memory 112*g*. On the basis of the readout data, the exposure start position is set at (X1,Y1). The image is exposed to the printing plate (raw plate) of each color at the interval ΔX=W/n in the X-axis direction and at the interval ΔY=H/m in the Y-axis direction.

The operator executes four-color printing on a reference printing paper sheet using the printing plates of the respective colors with the exposed images. After printing, the operator checks the image printed on the reference printing paper sheet and obtains the correction amount s1F of the paper convey apparatus 111 which prevents any shift in the distortion direction. The obtained correction amount s1F is set in the memory 110*j* of the image position correction control apparatus 110.

Next, shift amounts w1F2 and w2F2 in the horizontal direction and a shift amount hF2 in the vertical direction between the first-color image and the second-color image are obtained. In addition, shift amounts w1F3 and w2F3 in the horizontal direction and a shift amount hF3 in the vertical direction between the first-color image and the third-color image are obtained. Also, shift amounts w1F4 and w2F4 in the horizontal direction and a shift amount hF4 in the vertical direction between the first-color image and the fourth-color image are obtained. The obtained shift amounts are set in the memory 110*j* of the image position correction control apparatus 110.

Then, the operator exchanges the printing plates to which the second-, third-, and fourth-color images are exposed with raw plates and turns on the exposure start switch 110*d*2 of the input device 110*d*. When the exposure start switch 110*d*2 is turned on, the CPU 110*a* reads out, from the memory 110*j*, the reference correction amounts w1F2, w2F2, and hF2, the reference correction amounts w1F3, w2F3, and hF3, the reference correction amounts w1F4, w2F4, and hF4, and the reference correction amount s1F of the paper convey apparatus.

On the basis of the readout reference correction amounts w1F2, w2F2, and hF2, the CPU 110*a* obtains the X-coordinate of the left edge of the image to be exposed to the second-color printing plate as (X1−w1F2). The CPU 110*a* also obtains the pixel interval ΔX in the X-axis direction of the second-color image as ΔX=(W+w1F2+w2F2)/n and the pixel interval ΔY in the Y-axis direction as ΔY=(H+hF2)/m.

Similarly, on the basis of the readout reference correction amounts w1F3, w2F3, and hF3, the CPU 110*a* obtains the X-coordinate of the left edge of the image to be exposed to the third-color printing plate as (X1−w1F3). The CPU 110*a* also obtains the pixel interval ΔX in the X-axis direction of the third-color image as ΔX=(W+w1F3+w2F3)/n and the pixel interval ΔY in the Y-axis direction as ΔY=(H+hF3)/m.

Similarly, on the basis of the readout reference correction amounts w1F4, w2F4, and hF4, the CPU 110*a* obtains the X-coordinate of the left edge of the image to be exposed to the fourth-color printing plate as (X1−w1F4). The CPU 110*a* also obtains the pixel interval ΔX in the X-axis direction of the fourth-color image as ΔX=(W+w1F4+w2F4)/n and the pixel interval ΔY in the Y-axis direction as ΔY=(H+hF4)/m.

The CPU 110*a* sets the readout reference correction amount s1F of the paper convey apparatus in the memory 111*g* of the paper convey apparatus 111. The CPU 110*a* also sets the X-coordinate (X1−w1F2), the pixel interval ΔX=(W+w1F2+w2F2)/n in the X-axis direction, and the pixel interval ΔY=(H+hF2)/m in the Y-axis direction of the second-color image in the memory 112*g* of the image exposure apparatus 112-2. In a similar way, the CPU 110*a* sets the X-coordinate (X1−w1F3), the pixel interval ΔX=(W+w1F3+w2F3)/n in the X-axis direction, and the pixel interval ΔY=(H+hF3)/m in the Y-axis direction of the third-color image in the memory 112*g* of the image exposure apparatus 112-3. The CPU 110*a* also sets the X-coordinate (X1−w1F4), the pixel interval ΔX=(W+w1F4+w2F4)/n in the X-axis direction, and the pixel interval ΔY=(H+hF4)/m in the Y-axis direction of the fourth-color image in the memory 112*g* of the image exposure apparatus 112-4.

In the image exposure apparatus 112-2, the CPU 112*a* reads out the image position data (X1,Y1) in the memory 112*f*, and the X-coordinate (X1−w1F2) of the left edge of the image to be exposed to the printing plate, the pixel interval ΔX=(W+w1F2+w2F2)/n in the X-axis direction, and the pixel interval ΔY=(H+hF2)/m in the Y-axis direction, which are set in the memory 112*g*. On the basis of the readout data, the CPU 112*a* sets the exposure start position at (X1−w1F2, Y1). The image is exposed to the second-color printing plate at the interval ΔX=(W+w1F2+w2F2)/n in the X-axis direction and at the interval ΔY=(H+hF2)/m in the Y-axis direction.

Similarly, in the image exposure apparatus 112-3, the CPU 112*a* reads out the image position data (X1,Y1) in the memory 112*f*, and the X-coordinate (X1−w1F3) of the left edge of the image to be exposed to the printing plate, the pixel interval ΔX=(W+w1F3+w2F3)/n in the X-axis direction, and the pixel interval ΔY=(H+hF3)/m in the Y-axis direction, which are set in the memory 112*g*. On the basis of the readout data, the CPU 112*a* sets the exposure start position at (X1−w1F3,Y1). The image is exposed to the third-color printing plate at the interval ΔX=(W+w1F3+w2F3)/n in the X-axis direction and at the interval ΔY=(H+hF3)/m in the Y-axis direction.

In addition, in the image exposure apparatus 112-4, the CPU 112*a* reads out the image position data (X1,Y1) in the memory 112*f*, and the X-coordinate (X1−w1F4) of the left edge of the image to be exposed to the printing plate, the pixel interval ΔX=(W+w1F4+w2F4)/n in the X-axis direction, and the pixel interval ΔY=(H+hF4)/m in the Y-axis direction, which are set in the memory 112*g*. On the basis of the readout data, the CPU 112*a* sets the exposure start position at (X1−w1F4,Y1). The image is exposed to the fourth-color printing plate at the interval ΔX=(W+w1F4+w2F4)/n in the X-axis direction and at the interval ΔY=(H+hF4)/m in the Y-axis direction.

The operator executes four-color printing on a reference printing paper sheet using the second- to fourth-color printing plates with the exposed images, and the first-color printing plate with the already exposed image. In printing, when the printing paper sheet is transferred to the printing section, the paper convey apparatus 111 reads out the reference correction amount s1F set in the memory 111*g* and stretches the rear end portion of the printing paper sheet in the horizontal direction on the basis of the readout reference correction amount s1F, thereby deforming in advance the printing paper sheet into a trapezoidal shape whose width increases toward the trailing edge side.

After printing, the operator checks the image printed on the reference printing paper sheet. If the misregistration between the colors falls within the allowable range, the correction reference amount storage switch 110*d*3 of the input device 110*d* is turned on to determine the reference correction amounts w1Fi, w2Fi, hFi, and s1F of the respective colors in the memory 110*j*. If the misregistration between the colors falls outside the allowable range, the above-described operation is repeated until the misregistration falls within the allowable range.

[Generation of Unique Correction Amounts for Each Type of Printing Paper Sheet]

After the above-described reference correction amount generation, the operator turns on the unique correction amount storage mode switch 110*d*4 of the input device 110*d*. When the unique correction amount storage mode switch 110*d*4 is turned on, the CPU 110*a* resets all data in the memory 110*k* to 0. The memory 110*k* stores unique correction amounts w1i, w2i, and hi (i=1 to 4) of the exposure positions of images of the respective colors in correspondence with each type of printing paper sheet and unique distortion amounts s1i and s2i of the respective colors in correspondence with each type of printing paper sheet, as will be described later. All the unique values are reset to 0.

After that, the operator executes four-color printing on a printing paper sheet (a printing paper sheet to be used, which is of a type different from the reference printing paper sheet) other than the reference printing paper sheet using the printing plates of the respective colors. The operator checks the image printed on the printing paper sheet of a different type and obtains shift amounts w12 and w22 in the horizontal direction and a shift amount h2 in the vertical direction between the first-color image and the second-color image. In addition, shift amounts w13 and w23 in the horizontal direction and a shift amount h3 in the vertical direction between the first-color image and the third-color image are obtained. Also, shift amounts w14 and w24 in the horizontal direction and a shift amount h4 in the vertical direction between the first-color image and the fourth-color image are obtained. These shift amounts are set in the memory 110*k* of the image position correction control apparatus 110 as unique correction amounts.

The operator also obtains shift amounts s12 and s22 in the distortion direction between the first-color image and the second-color image, shift amounts s13 and s23 in the distortion direction between the first-color image and the third-color image, and shift amounts s14 and s24 in the distortion direction between the first-color image and the fourth-color image. These shift amounts are set in the memory 110*k* of the image position correction control apparatus 110 as unique distortion amounts.

In a similar way, unique correction amounts and distortion amounts are obtained for all types of printing paper sheets and set in the memory 110*k* of the image position correction control apparatus 110.

[Fan-Out Registration Correction Procedure in Actual Printing]

In actual printing, the operator turns on the fan-out registration correction switch 110*d*5 of the input device 110*d*. When the fan-out registration correction switch 110*d*5 is turned on, the CPU 110*a* reads out the images sizes "W" and "H" which are stored in the memory 110*i* together with image data. The CPU 110*a* calculates the data (X1,Y1) of the accurate image position and sets them in the memory 110*h* such that the W×H image matches the X-direction central position of the printing plate and the printing start position on the leading edge side.

The operator inputs the type of printing paper sheet to be used and turns on the exposure start switch 110*d*2 of the input device 110*d*. When the exposure start switch 110*d*2 is turned on, the CPU 110*a* reads out, from the memory 110*j*, the reference correction amounts w1Fi, w2Fi, and hFi of the exposure positions of images of the respective colors and the reference correction amount s1F of the paper convey apparatus. The CPU 110*a* also reads out, from the memory 110*k*, the unique correction amounts w1i, w2i, and hi of the exposure positions of images of the respective colors and the unique distortion amounts s1i and s2i of the respective colors in correspondence with the input printing paper sheet type.

The CPU 110*a* obtains the X-coordinate (X1−w1Fi−w1i) of the left edge of the image to be exposed to the printing plate of each color on the basis of the readout reference correction amounts w1Fi, w2Fi, and hFi and unique correction amounts w1i, w2i, and hi. The CPU 110*a* also obtains the pixel interval ΔX in the X-axis direction of the image of each color as ΔX=(W+w1Fi+w2Fi+w1i+w2i)/n and the pixel interval ΔY in the Y-axis direction as ΔY =(H+hFi+hi)/m.

The CPU 110*a* stores, in the memory 110*l*, the obtained value, i.e., the X-coordinate (X1−w1Fi−w1i) of the left edge of the image to be exposed to the printing plate of each color, the pixel interval ΔX=(W+w1Fi+w2Fi+w1i+w2i)/n in the X-axis direction of the image of each color, and the pixel interval ΔY=(H+hFi+hi)/m in the Y-axis direction of the image of each color. The CPU 110*a* also sets these data in the memory 112*g* of the image exposure apparatus 112 of each color. Next, the CPU 110*a* sets the data (X1,Y1) of the image position, which is set in the memory 110*h*, in the memory 112*f* of the image exposure apparatus 112 of each color.

In the image exposure apparatus 112 of each color, the CPU 112*a* reads out the image position data (X1,Y1) set in the memory 112*f*, and the X-coordinate (X1−w1Fi−w1i) of the left edge of the image to be exposed to the printing plate of a corresponding color, the pixel interval ΔX=(W+w1Fi+w2Fi+w1i+w2i)/n in the X-axis direction of the image of a corresponding color, and the pixel interval ΔY=(H+hFi+hi)/m in the Y-axis direction, which are set in the memory 112*g*. On the basis of the readout data, the CPU 112*a* sets the exposure start position at (X1,Y1). The image is exposed to the printing plate (raw plate) of each color at the interval ΔX=(W+w1Fi+w2Fi+w1i+w2i)/n in the X-axis direction and at the interval ΔY=(H+hFi+hi)/m in the Y-axis direction.

In the image position correction control apparatus 110, the CPU 110*a* reads out, from the memory 110*k*, the unique distortion amounts s1i and s2i of each color in correspondence with the type of printing paper sheet and obtains an average distortion amount (s1i+s2i)/2 of each color. Next, from the average distortion amount (s1i+s2i)/2 of each color, the CPU 110*a* obtains a unique correction amount s1 of the paper convey apparatus in correspondence with the type of printing paper sheet using a conversion table which is stored in the memory 110*o* and converts the distortion amount into the correction amount of the paper convey apparatus. The CPU 110*a* obtains a sum (s1F+s1) of the obtained unique correction amount s1 and the reference correction amount s1F stored in the memory 110*j* for storing reference correction amounts and stores the sum in the memory 110*n*. The CPU 110*a* sets this data in the memory 111*g* of the paper convey apparatus 111.

After that, the operator executes four-color printing on the printing paper sheet whose type is input in the preceding step, using the printing plates of the respective colors with the exposed images. In printing, when the printing paper sheet is transferred to the printing section, the paper convey apparatus 111 stretches the rear end portion of the printing paper sheet in the horizontal direction on the basis of the correction amount (s1F+s1) which is stored in the memory 111*g* in correspondence with the printing paper sheet, thereby deforming in advance the printing paper sheet into a trapezoidal shape whose width increases toward the trailing edge side.

The image is printed on the printing paper sheet which is deformed into the trapezoidal shape with a width increasing toward the trailing edge side. Hence, the stretch of the printing paper sheet during printing is eliminated or reduced, and the shift of the image due to distortion by the stretch of the printing paper sheet during printing is eliminated or reduced. For this reason, a normal printing product can be obtained.

Figure 8:
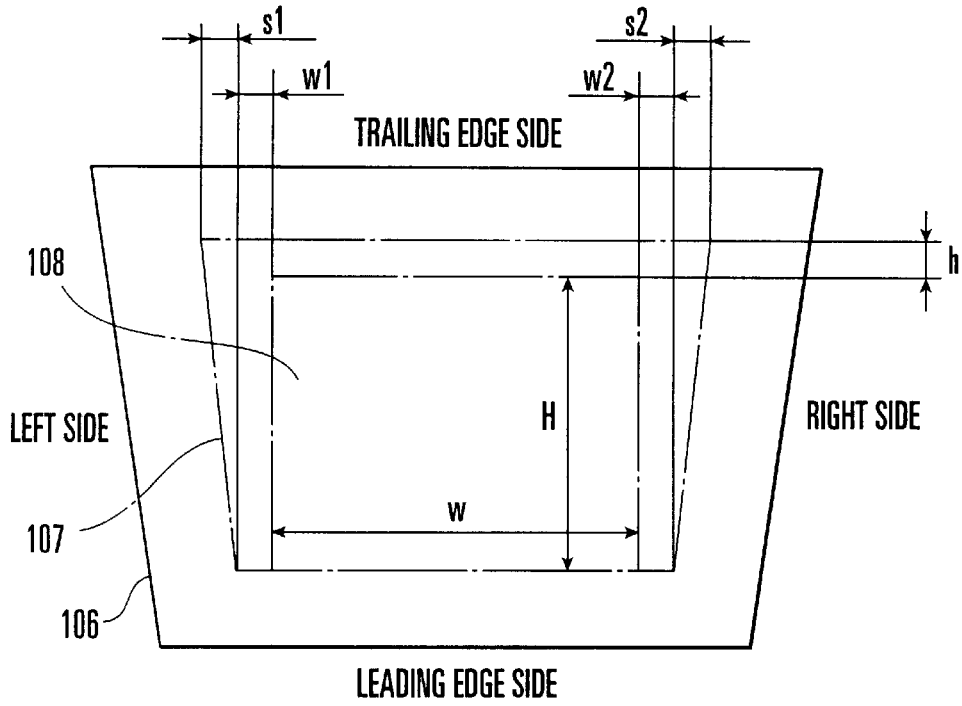
FIG. 8 is a view showing a printing paper sheet after printing by the second-color printing unit and an image printed on the printing paper sheet.

To the contrary, when the image data (image "1"/non-image "0") of each pixel is paired with the data of its exposure position and stored, and only the exposure position of each image is corrected, the resultant printing product has an image with a trapezoidal distortion as shown in FIG. 8. Hence, no normal printing product can be obtained.

According to this embodiment, since correction in the distortion direction is done using the image position correction control apparatus 110, only correction in the horizontal and vertical directions needs to be executed in exposing the image data of each pixel to the printing plate. For this reason, only the reference correction amounts w1Fi, w2Fi, hFi, and s1F and unique correction amounts w1i, w2i, hi, s1i, and s2i corresponding to the type of printing paper sheet need to be stored. Hence, a small storage capacity suffices. In addition, since only the X-coordinate of the left edge of the image to be exposed to the printing plate and the X-axis direction pixel interval and Y-axis direction pixel interval of the image need to be corrected, processing can easily be done in a short time.

This applies not only to a case wherein the paper convey apparatus is automatically controlled using the motor for the paper convey apparatus, as described in the above embodiment, but also to a case wherein the operator manually operates the paper convey apparatus.

In this embodiment, the reference correction amounts w1Fi, w2Fi, and hFi (i=1 to 4) of the exposure positions of images of all the four colors are stored in the memory 110*j*. In addition, the unique correction amounts w1i, w2i, and hi (i=1 to 4) of the exposure positions of images of all the four colors are stored in the memory 110*k* in correspondence with the type of printing paper sheet. However, the correction amounts w1F1, w2F1, and hF1 of the first-color image or the unique correction amounts w11, w21, and h1 of the first-color image corresponding to the type of printing paper sheet need not always be stored. That is, the reference correction amounts and unique correction amounts of the first-color image are always 0. Hence, when the image is to be exposed to the first-color printing plate, (X1,Y1) is used as the exposure start position, $\Delta X=W/n$ is used as the pixel interval in the X-axis direction, and $\Delta Y=H/m$ is used as the pixel interval in the Y-axis direction.

In this embodiment, plate making is executed on the printing press as plate making on press. However, the present invention can also be applied to a case wherein an image is exposed to a printing plate by a dedicated plate making machine separated from a printing press, and then, printing is executed by attaching the printing plate with the exposed image to the printing press.

In this embodiment, correction amounts are supplied from the image position correction control apparatus 110 to the paper convey apparatus 111. However, correction amounts to the paper convey apparatus 111 may be manually set as input values from the operator.

As has been described above, according to the present invention, in exposing an image to a printing plate, correction amounts set in accordance with the stretch amount of a printing paper sheet are read out, and the exposure position of each pixel of the image is adjusted on the basis of the correction amounts. With this arrangement, when the exposure start position (X1,Y1) of the image on the printing plate, the pixel interval $\Delta X$ in the X-axis direction, and the pixel interval $\Delta Y$ in the Y-axis direction are adjusted, any misregistration between the colors due to stretch of the printing paper sheet can be eliminated, and any defective printing product can be prevented.

What is claimed is:

1. An image exposure control apparatus comprising:

memory means for storing a correction amount for each color in accordance with a stretch amount of a printing paper sheet in multicolor printing operation; and adjustment means for adjusting an exposure position of a pixel of an image to be exposed for each color, on the basis of the correction amount read out from said memory means, in exposing the image on a printing plate.

2. An apparatus according to claim 1, further comprising distortion preventing means for deforming a trailing edge side of the printing paper sheet before start of printing, thereby preventing distortion of a shape of the image after printing.

3. An apparatus according to claim 2, wherein said distortion preventing means comprises a motor which rotates in accordance with the set correction amount, and a paper convey mechanism which stretches in advance the trailing edge side of the printing paper sheet as said motor rotates at the time of conveying the paper.

4. An apparatus according to claim 1, wherein said memory means comprises a first memory which stores a reference correction amount for each color in correspondence with a stretch amount of a reference paper sheet, and a second memory which stores a unique correction amount set in correspondence with a type of printing paper sheet, and said adjustment means adjusts the image exposure position on the basis of a value obtained by adding the reference correction amount and unique correction amount, which are respectively read out from said first and second memories.

5. An apparatus according to claim 4, wherein, as the reference correction amount for each color, said first memory stores a shift amount between an image of a first color and each of images of second and subsequent colors, which are printed on the reference printing paper sheets using the printing plates for respective colors, to which the image is exposed on the basis of image data and image position data obtained from an image size and the number of pixels in the image.

6. An apparatus according to claim 4, wherein, as the unique correction amount, said second memory stores a shift amount between an image of a first color and each of images of second and subsequent colors, which are printed on all printing paper sheets to be used, using the printing plates for respective colors, to which the image is exposed on the basis of image data and image position data obtained from an image size and the number of pixels in the image.

7. An apparatus according to claim 1, wherein said adjustment means adjusts, as the image exposure position, an image exposure start position and a pixel interval.

8. An apparatus according to claim 7, wherein said adjustment means adjusts, as the image exposure position, the image exposure start position in an X-axis direction and pixel intervals in the X- and Y-axis directions.

9. An image exposure control apparatus comprising:

memory means for storing a correction amount in accordance with a stretch amount of a printing paper sheet in printing operation; and adjustment means for adjusting an exposure position of a pixel of an image to be exposed, on the basis of the correction amount read out from said memory means, in exposing the image on a printing plate.

* * * * *